US006921116B2

(12) United States Patent
Humes

(10) Patent No.: US 6,921,116 B2
(45) Date of Patent: Jul. 26, 2005

(54) DOOR HANDLE ASSEMBLY

(75) Inventor: Gary L. Humes, Fort Atkinson, WI (US)

(73) Assignee: HOPPE North America, Inc., Ft. Atkinson, WI (US)

( * ) Notice: Subject to any disclaimer, the term of this patent is extended or adjusted under 35 U.S.C. 154(b) by 0 days.

(21) Appl. No.: 10/341,645

(22) Filed: Jan. 14, 2003

(65) Prior Publication Data

US 2004/0135377 A1 Jul. 15, 2004

(51) Int. Cl.[7] ..... E05C 1/12

(52) U.S. Cl. ..... 292/169; 292/169.21; 292/169.23; 292/336.3; 70/224

(58) Field of Search ..... 292/336.3, 336.5, 292/169, 169.21, 169.23, 165, 2, DIG. 61; 70/224

(56) References Cited

U.S. PATENT DOCUMENTS

| | | | | | |
|---|---|---|---|---|---|
| 129,527 | A | * | 7/1872 | Calhoun et al. | 292/169.21 |
| 1,326,450 | A | * | 12/1919 | Howard et al. | 49/460 |
| 2,615,744 | A | * | 10/1952 | Colonna | 292/169.21 |
| 2,723,150 | A | * | 11/1955 | Teich | 292/336.3 |
| 2,727,773 | A | * | 12/1955 | Hagstrom | 292/169.19 |
| 2,796,272 | A | * | 6/1957 | Quinn | 292/67 |
| 3,136,572 | A | * | 6/1964 | Lytle | 292/336.3 |
| 4,428,212 | A | * | 1/1984 | Best et al. | 70/224 |
| 4,756,178 | A | * | 7/1988 | Shen | 70/380 |
| 4,920,773 | A | * | 5/1990 | Surko, Jr. | 70/224 |
| 4,982,986 | A | * | 1/1991 | Gressett et al. | 292/336.3 |
| 4,988,136 | A | * | 1/1991 | Gressett, Jr. | 292/336.3 |
| 5,083,823 | A | * | 1/1992 | Fann et al. | 292/359 |
| 5,177,987 | A | * | 1/1993 | Shen | 70/224 |
| 5,205,596 | A | * | 4/1993 | Ralph | 292/336.3 |
| 5,335,948 | A | * | 8/1994 | Norton et al. | 292/169.23 |
| 5,335,950 | A | * | 8/1994 | Mirshafiee et al. | 292/356 |
| 5,433,497 | A | * | 7/1995 | Koenig | 292/359 |
| 5,529,354 | A | * | 6/1996 | Studt et al. | 292/336.3 |
| 5,628,216 | A | * | 5/1997 | Qureshi et al. | 70/278.7 |
| 5,658,026 | A | * | 8/1997 | Nigro et al. | 292/336.3 |
| 5,732,578 | A | * | 3/1998 | Kang | 70/224 |
| 5,752,727 | A | | 5/1998 | Zues et al. | |
| 5,775,745 | A | * | 7/1998 | Hoppe et al. | 292/138 |
| 6,174,005 | B1 | * | 1/2001 | Norton | 292/169.21 |
| 6,302,453 | B1 | * | 10/2001 | Norton | 292/169.21 |
| 6,386,602 | B1 | * | 5/2002 | Lan | 292/336.3 |
| 6,425,273 | B1 | * | 7/2002 | Kim et al. | 70/224 |
| 6,491,327 | B1 | * | 12/2002 | Fan | 292/165 |
| 6,553,799 | B2 | * | 4/2003 | Bates et al. | 70/224 |
| 6,651,466 | B1 | * | 11/2003 | Shih | 70/107 |
| 6,676,178 | B2 | * | 1/2004 | Budhrani | 292/357 |

FOREIGN PATENT DOCUMENTS

| | | | |
|---|---|---|---|
| GB | 597382 | * | 1/1948 |

* cited by examiner

*Primary Examiner*—Daniel P. Stodola
*Assistant Examiner*—Carlos Lugo
(74) *Attorney, Agent, or Firm*—Reinhart Boerner Van Deuren s.c.

(57) ABSTRACT

A door handle assembly includes a bias mechanism that maintains inside and outer handles in a generally horizontal position in which a latching bolt of a latching bolt mechanism is fully extended, the latching bolt being retracted upon rotating either handle only about 28° from the horizontal retracting the latching bolt to allow opening of a door on which the door handle assembly is installed.

16 Claims, 3 Drawing Sheets

DOOR HANDLE ASSEMBLY

BACKGROUND OF THE INVENTION

Field of the Invention

The present invention relates generally door handle assemblies and the like, and, more particularly, to a door handle assembly.

Door lever handle assemblies are conventionally mounted with the lever handle positioned horizontally. This orientation requires that the weight of the lever portion of the handle be supported against the force of gravity. In many door handle assemblies, this support normally is provided by spring commonly used in cylinder locks to extend the latching bolt to allow opening of a door on which the lever handle assembly is installed. The spring is compressed as the lever handle is rotated, providing a return bias force for returning the lever handle to a horizontal position when the lever handle is released. However, the use of the cylinder lock bias spring to provide sufficient bias force to return the lever handle to a horizontal position requires that the lever handle be rotated about 60° or more in opening the door.

Thus, most known lever type door handles must be rotated at least 45°, and typically about 60°, from a horizontal position to withdraw the latching bolt to allow opening of a door on which the door lever handle is installed. However, it can be difficult for some physically challenged individuals to rotate a door lever handle 60° or even as much as 45°.

It is accordingly the primary objective of the present invention to provide an improved door handle assembly.

It is another objective of the present invention to provide a door handle assembly that requires a relative small angle of rotation between the latching and unlatching positions.

Another objective of the present invention is to provide a door handle assembly including an improved bias structure for returning a lever handle from an unlatching position to a generally horizontal latching position.

The door handle assembly of the present invention must also be of construction which is both durable and long lasting, and it should also require little or no maintenance to be provided by the user throughout its operating lifetime. In order to enhance the market appeal of the apparatus of the present invention, it should also be of inexpensive construction to thereby afford it the broadest possible market. Finally, it is also an objective that all of the aforesaid advantages and objectives be achieved without incurring any substantial relative disadvantage.

SUMMARY OF THE INVENTION

The disadvantages and limitations of the background art discussed above are overcome by the present invention. With this invention, there is provided a door handle assembly. In one embodiment, the door handle assembly includes at least one door handle and a chassis assembly including a body, a spindle and a bias mechanism. The spindle is mounted on the body for rotational movement relative to the body. The door handle is mounted on the spindle and indexed to the spindle handle to prevent relative rotation between the door handle and the spindle. The spindle is rotatable by the door handle between latching and unlatching positions. The bias mechanism is coupled to the spindle for producing a return bias force in response to rotation of the spindle as the door handle is rotated away from the latching position toward the unlatching position for returning the door handle to the latching position upon release of the door handle. The angle of rotation of the door handle between the latching position and the unlatching position is less than 45°. In a preferred embodiment, the angle of rotation of the door handle between the latching and unlatching positions is about 28°.

In one embodiment, the bias mechanism includes at least one bias structure including a bias element and an actuating member coupled to the spindle and cooperating with the bias element for causing the bias element to produce the return bias force in response to rotation of the door handle away from the latching position toward the unlatching position.

The door handle assembly can include a second door handle indexed to the spindle, and a second bias structure that includes a second bias element and a second actuating member for causing the second bias element to produce the return bias force in response to rotation of the second door handle away from the latching position toward the unlatching position. The second actuating member is operated in response to rotation of the second door handle and independently of the operation of the first actuating member. The spindle can be a split member, allowing the first and second actuating members to be operated independently of one another.

The apparatus of the present invention is of a construction which is both durable and long lasting, and which will require little or no maintenance to be provided by the user throughout its operating lifetime. The apparatus of the present invention is also of inexpensive construction to enhance its market appeal and to thereby afford it the broadest possible market. Finally, all of the aforesaid advantages and objectives are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
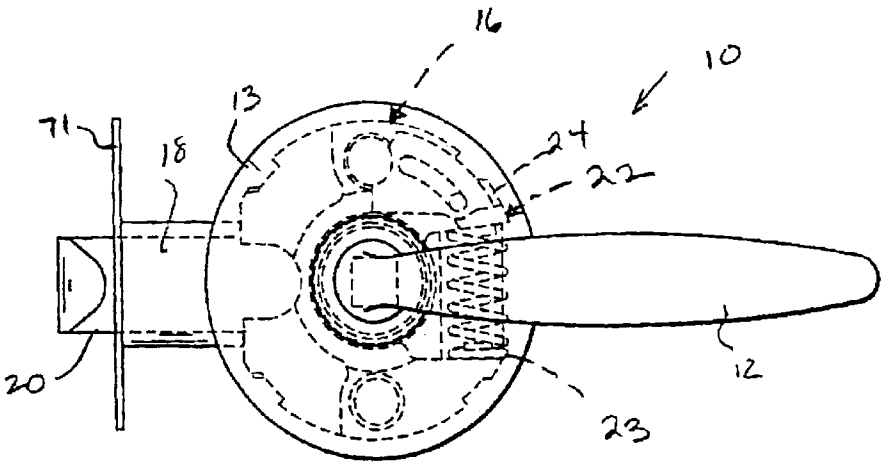
FIG. 1 is a side elevation view of a door handle assembly of the present invention, with the handle shown positioned horizontally in an at rest position in which a latching bolt is extended.
Figure 2:
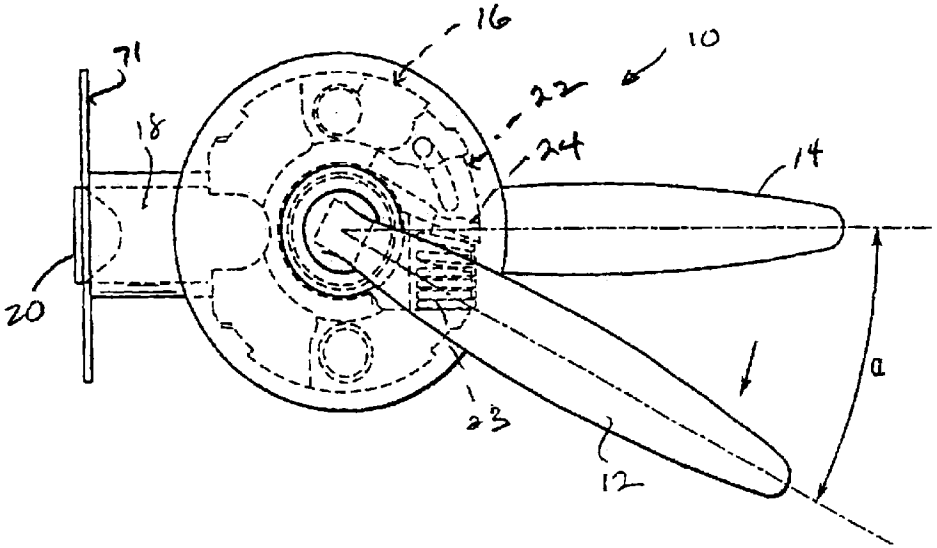
FIG. 2 is a view similar to that of FIG. 1 and with the handle rotated away from the horizontal position to a retracting position in which the latching bolt is retracted.

Referring to the drawings, FIG. 1 shows a preferred embodiment of a door handle assembly 10 in accordance with the present invention. The door handle assembly 10 includes an outside handle 12, an inside handle 14 (shown in FIG. 2), a chassis assembly 16 and a latching bolt assembly 18. The door handle assembly 10 also includes an outside handle cover 13 and an inside handle cover (not shown) as is conventional. The outside handle 12 is shown in a horizontal or rest position in FIG. 1, the inside handle 14 (not shown in FIG. 1) also being in a horizontal or rest position. FIG. 2 shows the door handle assembly 10 after the outside handle 12 has been rotated to the unlatching position in which a latching bolt 20 of the latching bolt assembly 18 is retracted.

In accordance with the present invention, the door handle assembly 10 includes a bias mechanism that maintains the outside handle 12 and the inside handle 14 in a generally horizontal position in which a latching bolt 20 of the latching bolt assembly 18 is fully extended. The latching bolt 20 is retracted upon rotating either the outside handle 12 or the inside handle 14 a predetermined angular distance, represented by angle $\alpha$ in FIG. 2, away from the horizontal position. In one preferred embodiment, the angle $\alpha$ is less than 45°, and preferably, only about 28°, so that a handle need be rotated only about 28°, for example, from the horizontal position to fully retract the latching bolt 20, allowing opening of door on which a door handle assembly 10 is mounted.

Referring to FIGS. 1 and 2, the bias mechanism is part of the chassis assembly 16 and includes an outside handle bias structure 22 that normally maintains the outside handle 12 in a generally horizontal position. The outside handle bias structure 22 includes a bias element 23 and an actuating member 24. In the preferred embodiment, the bias element 23 is a coil spring used as a compression spring. The bias mechanism further includes an inside handle bias structure 26, indicated generally by reference number in FIG. 3, that normally maintains the inside handle 14 in a generally horizontal position, also requiring only about 28° and preferably about 28° of rotation of the handle 14 from a horizontal position to the unlatching position. The inside handle bias structure 26 includes a bias element 27 and an actuating member 28. In the preferred embodiment, the bias element 27 is a coil spring used as a compression spring. However, with suitable modifications to the bias structure 22 (and bias structure 26),the bias elements 23 and 27 can be leaf springs, or coil springs operated in tension mode or other resilient bias elements.

Figure 3:
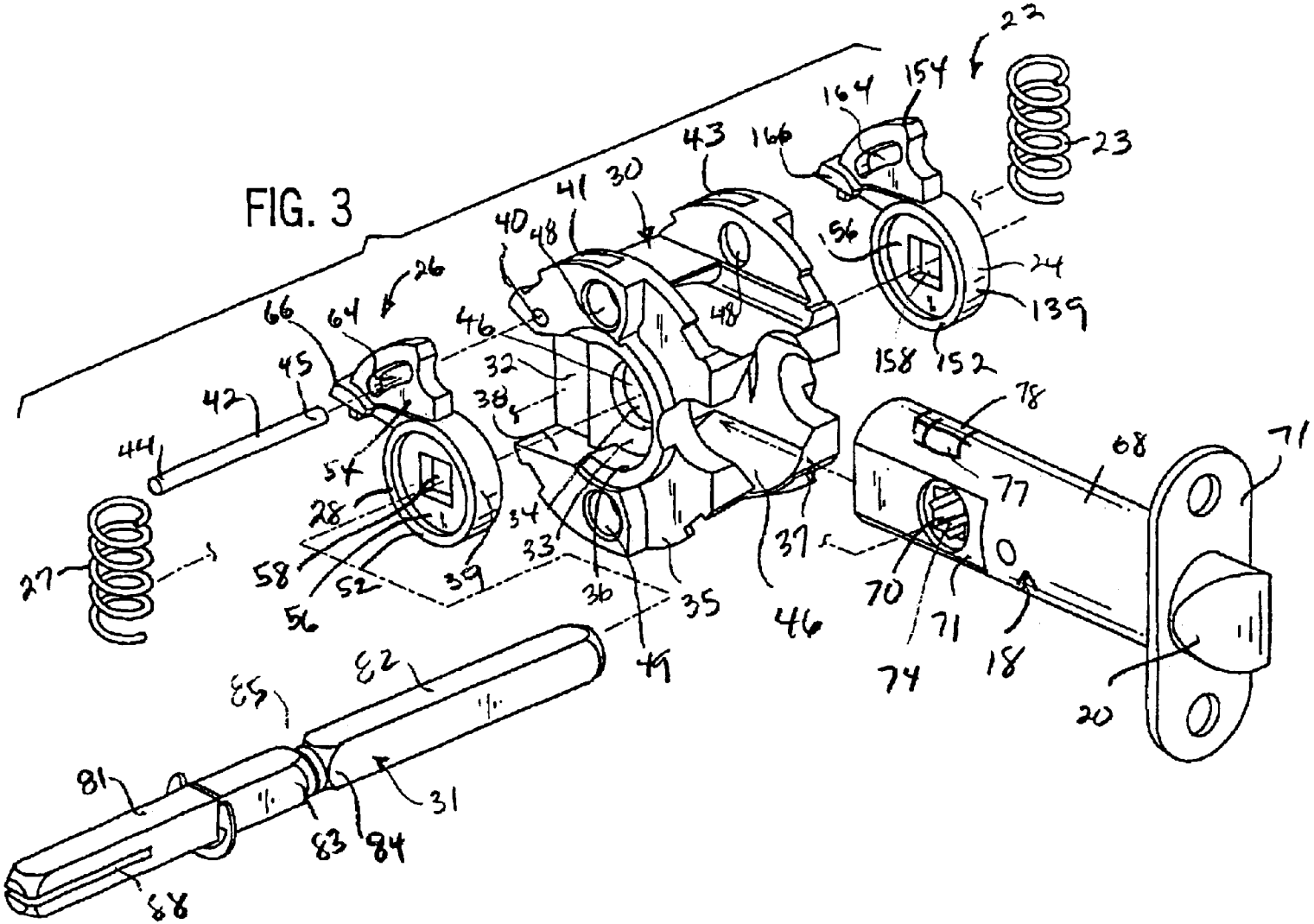
FIG. 3 is an exploded view of a chassis assembly of the door handle assembly of FIG. 1, and showing a latching bolt assembly and a handle mounting spindle of the handle assembly of FIG. 1.

More specifically, reference is now made to FIG. 3, which is an exploded view showing the chassis assembly 16 and the latching bolt assembly 18. In addition to the outside handle bias structure 22 and the inside handle bias structure 26, the chassis assembly 16 includes a body 30 and a spindle 31. The outside handle 12 and the inside handle 14 and associated hardware are conventional and accordingly are not shown in FIG. 3.

The body 30 of the chassis assembly 16 defines a recess 32 at one end 35 for mounting the actuating member 28 of the inside handle bias structure 26 for rotation relative to the body 30. The recess 32 has a flat inner wall 33 with a circular opening 34 therethrough. The recess 32 has an arcuate inner surface 36 partially surrounding the inner wall 33, the inner surface 36 of the sidewall defining a bearing surface for a curved outer surface 39 of actuating member 28. The body 30 further includes a flat surface 38 for supporting the lower end of the compression spring 27 as will be shown.

Figure 5:
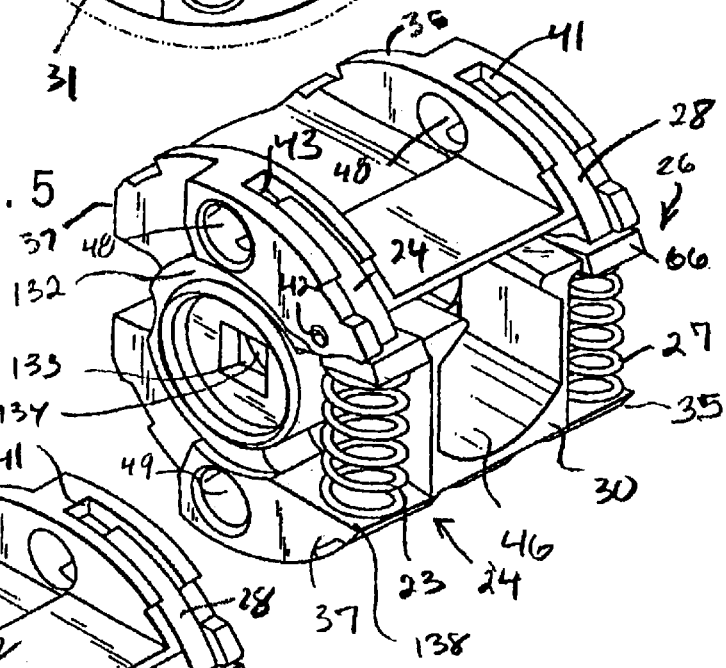
FIG. 5 is an isometric view of the chassis assembly of FIG. 4, and with the outer bias actuating member shown in the at rest position.

Referring also to FIG. 5, the body 30 defines a further recess 132 at the opposite end 37 of the body 30. The further recess 132 has similar mounting surfaces for the outside handle bias structure 22, the mounting surfaces of recess 132 being of mirror image symmetry with mounting surfaces of recess 32, including an inner wall 133 having an opening 134 corresponding in shape and aligned with opening 34 in inner wall 33. Thus, the outer handle bias structure 22 and the inner handle bias structure 26 are located at opposite ends of the body 30 and with the bias elements 23 and 27 located on the same side of the body.

The body 30 includes a through bore 40 that receives a pin 42. The ends 44 and 45 of the pin 42 project out from the body 30 at opposite ends 35 and 37 thereof, and extend into the guide slots 64 and 164 of the actuator members for defining length of travel for the actuating members. The body 30 includes aligned pairs of apertures 48 and 49 near the top and bottom of the body to facilitate installation of the chassis assembly 16 on a door.

The body 30 includes a transverse bore 46, shown in FIG. 5, that is generally circular in cross-section and through which extends the latching bolt assembly 18 when the door assembly 10 is assembled.

Referring to FIG. 3, the actuating member 28 of the inside handle bias structure 26 includes a drive portion 52 and a cam portion 54 carried by the drive portion 52. The drive portion 52 is generally disc shaped and includes a flat center 56 having an index opening 58. The drive portion 52 has an annular peripheral surface 39. The cam portion 54 projects from an upper portion of the annular peripheral surface 39 of the drive portion 52 and includes an arcuate guide slot 64. The cam portion further defines an enlarged, flat spring engaging surface 66.

The actuating member 24 of the outside handle bias structure 22 can be identical in size and configuration to the actuating member 28 of the inside handle bias structure 26 and accordingly corresponding portions of actuating member 24 have been given the same reference number as like portions of actuating member 28, but with "100" added. Thus, the actuating member 24 includes a drive portion 152 having an index opening 158, a cam portion 154 with a flat surface 166, and a guide slot 164, for example.

Referring also to FIG. 5, the body 30 includes an arcuate slot 41 near end 35, open at its outer end, for locating the actuating member 28 when the bias structure 26 is assembled on the body 30. When the bias structure 26 is assembled on the body 30, the compression spring 27 is located within the space 67 between the surface 38 of the body 30 and the spring engaging surface 66 of the actuating member 28. The body 30 includes a corresponding open ended, arcuate slot 43 near end 37 for locating the actuating member 24.

When the bias structures 22 and 26 are assembled on the body 30, the actuating members 24 and 28 are located at opposite ends of the body 30 in respective recesses 132 and 32, with the index opening 58 of actuating member 28 aligned with the index opening 158 of actuating member 24. Also, guide slot 64 is aligned with guide slot 164, with opposite ends of pin 42 extending into slots 64 and 164. Guide slots 64 and 164 define the rotational length of travel of the acutating members 28 and 24.

Referring to FIGS. 1 and 3, the latching bolt assembly 18 can be of the conventional type in which the axis of movement of the latching bolt 20 is perpendicular to the axis of rotation of the spindle 31, and thus, the axis of rotation of the handles 12 and 14 which are attached to the spindle 31 in the assembled door handle assembly 10. The latching bolt assembly 18 can include a mounting plate 71 to facilitate securing the latching bolt assembly 18 to a door with the latching bolt assembly 18 extending transversely to the mounting axis of the handles 12 and 14 and the axis of the spindle 31.

The latching bolt assembly 18 includes a generally cylindrical housing 68 that contains a transmission mechanism 70 that converts rotational movement of the handles 12 and 14 into axial movement for the latching bolt 20. The handles 12 and 14 are coupled to the latching bolt assembly 18 by the spindle 31. The latching bolt 20 is extended from the housing 68 when both handles 12 and 14 are in the horizontal position and the latching bolt 20 is retracted into the housing 68 whenever either one of the handles is rotated to the unlatching position.

The housing has a transverse opening 71 in which is exposed a portion of the transmission mechanism 70. The transmission mechanism 70 includes an opening 74 therethrough the inner surface of which is generally rectangular in shape and conforms to the outer surface of the spindle 31. The transmission mechanism 70 has an inside handle operated transmission portion 77 and an outside handle operated transmission portion 78, which are independently operable to extend and retract the latching bolt 20.

The transmission mechanism 70 establishes the amount of rotation of the spindle 31, and thus the amount of rotation of the handles 12 and 14, that is required to retract the latching bolt 20 substantially completely into the housing 68. As is stated above, in the preferred embodiment, the amount of rotation is less than 45° and preferably is about 28°.

The latching bolt assembly 18 can be similar to those known in the art. For example, the latching bolt assembly can be similar to that disclosed in U.S. Pat. No. 5,775,745, assigned to Hoppe Holding AG, which patent is incorporated herein by reference in its entirety. However, the transmission mechanism 70 is set to produce substantially complete retraction of the latching bolt 20 into the housing 68 in response to about 28° of rotation of either one of the handles 12 and 14.

Referring to FIG. 3, the spindle 31 is an elongated assembly which is rectangular in cross-section over most of its extent. In the preferred embodiment, the spindle 31 is of a two-part construction, enabling independent operation of the handles 12 and 14, and of the actuating members 24 and 28, allowing rotation of the outside handle 12 away from the horizontal without rotation of the inside handle 14 and rotation of the inside handle 14 away from the horizontal without rotation of the outside handle 12. To this end, the spindle 31 includes a center portion 85 that is necked down, defining an inside spindle portion 81, that is generally rectangular in shape, and an outside spindle portion 82, also generally rectangular in shape. The inside and outside spindle portions 81 and 82 are pivotally interconnected at their respective inner ends 83 and 84, enabling relative rotation between the spindle portions 81 and 82. Spindles of this type are known in the art. In an alternative embodiment, the spindle can be a one-piece element, in which case both the outside and inside handles 12 and 14 are rotated when either one of the handles is rotated, and both of the bias springs 23 and 27 are compressed when either one of the handles 12 or 14 is rotated away from the horizontal position toward the unlatching position.

The rectangularly-shaped outer surface of the spindle portion 81 mates with a corresponding rectangularly-shaped blind hole in the inside handle 14. Similarly, the rectangularly outer surface of the spindle portion 82 mates with a corresponding rectangularly-shaped blind hole in the outside handle 12. One of the spindle portions 81 includes a longitudinally extending slot 88 to facilitate securing one of the handles, such as the inner handle 14, to the spindle 31.

Figure 4:
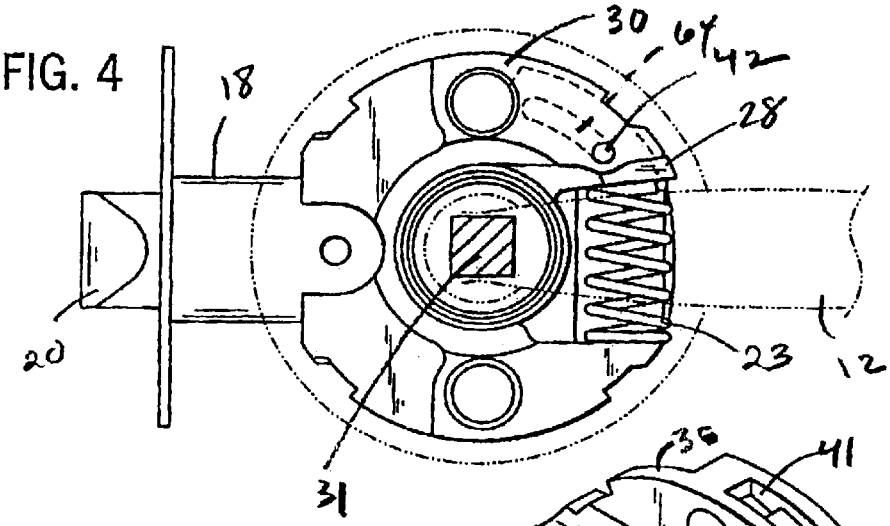
FIG. 4 is a side elevation view of the chassis assembly of FIG. 3, shown assembled with the latching bolt assembly and the handle mounting spindle, and with the outer handle assembly shown in phantom.

Referring also to FIGS. 4 and 5, in the door handle assembly 10, the spindle 31 carries the actuating member 24 at one end as shown in FIG. 4 and the actuating member 28 at the other end. The spindle 31 extends through aligned openings including index opening 58 in the actuating member 28, opening 34 in the body 30, opening 74 in the transmission mechanism 70, opening 134 in the body 30 and index opening 158 in the actuating member 24. The spindle portion 81 engages the actuating member 28 and is indexed to the inside handle operated transmission portion 77 of the transmission mechanism 70. The spindle portion 82 engages the actuating member 24 and is indexed to the outside handle operated portion 78 of the transmission mechanism 70.

Referring to FIGS. 1 and 3, the outside handle 12 and the inside handle 14 are mounted on the spindle 31 in the conventional manner with one of the handles being secured to the spindle 31 by way of a set screw (not shown) that cooperates the slot 88 in the spindle 31 in the conventional manner.

Figure 6:
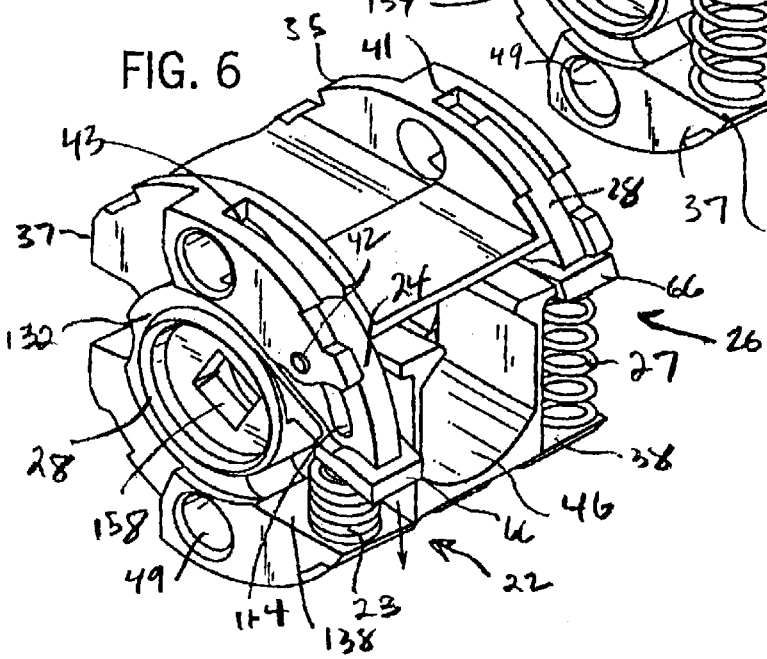
FIG. 6 is a view similar to that of FIG. 5 and with the outer bias actuating member shown rotated to a retracting position in which the latching bolt retracted.

Referring to FIGS. 1 and 5, in operation, the bias structure normally maintains the handles 12 and 14 in a generally horizontal position. When the outside handle 12 is rotated from the horizontal position to the position shown in FIG. 2, the actuating member 24 is rotated, as shown in moving against the force of the return spring 23 between the end 66 of the actuating member 24 and surface 138 of the body 30, compressing the return spring, as shown in FIG. 6, and retracting the latching bolt 20 into the housing 68. The latching bolt 20 is retracted substantially completely into the housing 68 when the outside handle 12 has been rotated about 28°, allowing opening of a door on which the handle assembly 10 is mounted. It is pointed out that in this embodiment, the inside handle 14 is not rotated along with the outside handle 12 and so the inside handle 14 remains in the horizontal position and the actuating member 28 does not compress the return spring 25. When released, the outside handle 12 is returned to the generally horizontal position under the force of the return spring 23.

Similarly, when, the inside handle 14 is rotated, the actuating member 28 is rotated by the inside handle 14 against the force of the return spring 27, compressing the return spring 27 to provide a bias force for returning the inside handle 14 to the horizontal position when the inside handle 14 is subsequently released.

If the spindle 31 interconnects the inside and outside handles 14 and 12, then rotation of either handle will result in rotation of the other handle and both return springs 23 and 27 will be compressed.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A door handle assembly comprising:

a first door handle;

a chassis assembly including a body;

a spindle mounted on the body for rotational movement relative to said body, said first door handle mounted on said spindle and indexed to said spindle to prevent relative rotation between said first door handle and said spindle, said spindle rotatable by said first door handle between latching and unlatching positions; and a bias mechanism coupled to said spindle for producing a return bias force in response to rotation of said spindle as said first door handle is rotated away from the latching position toward the unlatching position, for returning said door handle to the latching position upon release of said first door handle, said bias mechanism including a first bias structure including a first bias element and a first actuating member coupled to said spindle and cooperating with said first bias element for causing said first bias element to produce said return bias force in response to rotation of said first door handle away from the latching position toward the unlatching position; and a second door handle indexed to said spindle, said bias mechanism including a second bias structure, said second bias structure including a second bias element and a second actuating member for causing said second bias element to produce said return bias force in response to rotation of said second door handle away from the latching position toward the unlatching position, said second actuating member operated in response to rotation of said second door handle and independently of the operation of said first actuating member, wherein the angle of rotation of said door handles between the latching position and the unlatching position is less than 45°.

2. The door handle assembly according to claim 1, wherein the amount of angular rotation of said first and second door handles between the latching and unlatching positions is about 28°.

3. The door handle assembly according to claim 1, wherein said first actuating member includes an arcuate guide slot and a member coupled to said body and projecting from said body into the guide slot for defining length of travel for said first actuating member.

4. The door handle assembly according to claim 1, wherein first and second bias elements comprise first and second compression springs, respectively, and wherein said first and second actuating members are operated independently of one another for compressing said first and second compression springs, allowing said first and second compression springs to be compressed independently of one another.

5. The door handle assembly according to claim 1, wherein said second actuating member is coupled to said spindle, and wherein said spindle is a split member, allowing said first and second actuating members to be operated independently of one another.

6. A door handle assembly comprising:

a first door handle;

a chassis assembly including a body;

a spindle mounted on the body for rotational movement relative to said body, said first door handle mounted on said spindle and indexed to said spindle to prevent relative rotation between said first door handle and said spindle, said spindle rotatable by said first door handle between latching and unlatching positions; and a bias mechanism coupled to said spindle for producing a return bias force in response to rotation of said spindle as said first door handle is rotated away from the latching position toward the unlatching position, for returning said first door handle to the latching position upon release of said first door handle, said bias mechanism including a first bias structure including a first bias element and a first actuating member coupled to said spindle and cooperating with said first bias element for causing said first bias element to produce said return bias force in response to rotation of said first door handle away from the latching position toward the unlatching position;

said door handle assembly including a second door handle, said bias mechanism including a second bias structure including a second bias element and a second actuating member, said second actuating member coupled to said spindle and cooperating with said bias element for causing said second bias element to produce said return bias force in response to rotation of either one of said door handles, wherein the angle of rotation of said first and second door handles between the latching position and the unlatching position is less than 45°.

7. A door handle assembly comprising:

first and second door handles;

a chassis assembly including a body and a spindle mounted on the body for rotational movement relative to said body, said first and second door handles mounted on said spindle and indexed to said spindle to prevent relative rotation between said first and second door handles and said spindle, said spindle rotatable by either one of said door handles between latching and unlatching positions; and a bias mechanism including a first bias structure including at least a first bias element and a first actuating member indexed to said spindle to prevent relative rotation between said first actuating member and said spindle, said first actuating member causing said first bias element to produce said return bias force in response to rotation of one of said door handles from the latching position toward the unlatching position, and a second bias structure, said second bias structure including a second bias element and a second actuating member for causing said second bias element to produce said return bias force in response to rotation of the other one of said door handles away from the latching position; wherein the angle of rotation of either one of said door handles between a generally horizontal latching position and an unlatching position is less than 45°.

8. The door handle assembly according to claim 7, wherein the amount of angular rotation of either one of said door handles between said generally horizontal position and said unlatching position is about 28°.

9. The door handle assembly according to claim 7, wherein said second actuating member is indexed to said spindle, and wherein said spindle is a split member, allowing said first and second actuating members to be operated independently of one another.

10. The door handle assembly according to claim 7, wherein said first and second bias elements comprise first and second compression springs, respectively, and wherein said first and second actuating members are operated independently of one another, allowing said first and second compression springs to be compressed independently of one another.

11. A door handle chassis assembly comprising:

a body;

a spindle mounted in said body for rotation relative to said body;

a first bias structure including a first bias element and a first actuating member indexed to said spindle to prevent relative rotation between said first actuating member and said spindle; and a second bias structure including a second bias element and a second actuating member indexed to said spindle, wherein the angle of rotation of the actuating members between a first position and a second position is less than 45°.

12. The door handle chassis assembly according to claim 11, wherein the amount of angular rotation of said spindle between said latching and unlatching positions is about 28°.

13. The door handle chassis assembly according to claim 11, therein said first actuating member includes a guide member in said chassis assembly and a guide slot that cooperates with the guide member to define limit of travel for said spindle.

14. The door handle chassis assembly according to claim 11, wherein said first and second bias elements comprise first and second compression springs, respectively, and wherein said first and second actuating members are operated independently of one another for compressing said first and second compression springs in response to rotation of said spindle, allowing said first and second compression springs to be compressed independently of one another.

15. The door handle chassis assembly according to claim 14, wherein said first compression spring has one end supported on a surface of said body, and said first actuating member includes an actuating portion that extends in overlying relation with and coupled to an opposite end of said first compression spring.

16. A door handle assembly comprising:

a first door handle;

a chassis assembly including a body;

a spindle mounted on the body for rotational movement relative to said body, said first door handle mounted on said spindle and indexed to said spindle to prevent relative rotation between said first door handle and said spindle, said spindle rotatable by said first door handle between latching and unlatching positions; and a bias mechanism coupled to said spindle for producing a return bias force in response to rotation of said spindle as said first door handle is rotated away from the latching position toward the unlatching position, for returning said door handle to the latching position upon release of said first door handle, said bias mechanism including a first bias structure including a first bias element and a first actuating member coupled to said spindle and cooperating with said first bias element for causing said first bias element to produce said return bias force in response to rotation of said first door handle away from the latching position toward the unlatching position; and a second door handle indexed to said spindle, said bias mechanism including a second bias structure, said second bias structure including a second bias element and a second actuating member for causing said second bias element to produce said return bias force in response to rotation of said second door handle away from the latching position toward the unlatching position, said second actuating member operated in response to rotation of said second door handle and independently of the operation of said first actuating member.

* * * * *